US005683111A

United States Patent [19]

Bass et al.

[11] Patent Number: 5,683,111

[45] Date of Patent: Nov. 4, 1997

[54] BINDER SYSTEM AND KIT

[75] Inventors: Richard L. Bass, West Jordon; Louis Michael Trani, Holladay, both of Utah

[73] Assignee: Image Bind, L.L.C., Salt Lake City, Utah

[21] Appl. No.: 584,340

[22] Filed: Jan. 11, 1996

[51] Int. Cl.[6] ..... B42D 1/00

[52] U.S. Cl. ..... 281/21.1; 281/15.1; 281/29

[58] Field of Search ..... 281/15.1, 21.1, 281/29, 31, 36, 37, 51; 402/70, 73, 4

[56] References Cited

U.S. PATENT DOCUMENTS

| | | | |
|---|---|---|---|
| 4,964,656 | 10/1990 | Prentice | 281/31 X |
| 5,120,176 | 6/1992 | Bhatin et al. | 281/21.1 X |
| 5,407,230 | 4/1995 | Brink et al. | 281/21.1 X |
| 5,575,505 | 11/1996 | Bridges | 281/36 |

FOREIGN PATENT DOCUMENTS

| | | | |
|---|---|---|---|
| 110237 | 6/1984 | European Pat. Off. | 281/21.1 |
| 246850 | 11/1987 | European Pat. Off. | 281/21.1 |
| 1382574 | 11/1964 | France | 281/21.1 |

*Primary Examiner*—Willmon Fridie, Jr.
*Attorney, Agent, or Firm*—M. Reid Russell

[57] ABSTRACT

A binder system having a cover with interior and exterior front and back segments large enough to cover a plurality of pages with edges separated by a spine segment having a plurality of parallel scores defining substantially parallel spinal subsegments which bend and are secured to the edges of a plurality of papers with adhesive strips with removable covers to the spinal subsegments.

10 Claims, 6 Drawing Sheets

BINDER SYSTEM AND KIT

BACKGROUND OF THE INVENTION

1. Field

This invention pertains to binder systems. More particularly, it provides a flexible multiple fold presentation binder and kit especially adapted to conceal stapled, glued, and/or fastened edges of pages of project reports, sales proposals, presentations, greeting card .products, catalogues, brochures, and the like.

2. State of the Art

Numerous book binding systems are known. Hutchinson, U.S. Pat. No. 5,437,476 discloses an apparatus and method for binding booklets using pressure seal adhesive patterns. Giulie, U.S. Pat. No. 4,007,950 discloses a binder unit for stapled booklets. Konkel, U.S. Pat. No. 3,347,565 discloses a binding method for a manuscript employing an elongated binding strip with four sections for multiple folds secured to edge of a manuscript and a cover. Roche, U.S. Pat. No. 474,483 discloses a covered post bookbinding to secure pages between covers. Groswith III, U.S. Pat. No. 4,743,048 discloses a multi-fold adjustable binder book and method for a stack of punched hole paper sheets utilizing various headed fastener members with a post insertable in the punched holes from one side of the stack to secure the sheets between corresponding covers. Groswith III, et al, U.S. Pat. No. 4,887,925 discloses a prong and tang binding system to secure perforated pages between a cover. Cognata, U.S. Pat. No. 4,351,546 discloses a cover for a channel clip binder and method for making the same wherein the marginal edges of a stack of leaves to be bound together are clipped between a pair of resilient side walls of a channel clip member attached along the spine of a folding cover having front and back portions.

The invention and kit described below provides a simple binder system and kit to quickly and efficiently assemble reports, sales presentations, making greeting cards, brochure covers, etc. without the need for complicated binding fasteners and clips.

SUMMARY OF THE INVENTION

The invention comprises a binder having a cover with segments large enough to cover desired portions of a plurality of pages with edges. In the preferred embodiment, the cover has a central spine segment connecting interior and exterior front and back cover segments which cover entire portions of a plurality of pages with edges inserted therebetween and fastened to the spine segment. Typically, these covers are sized to accommodate conventional 8½ by 11 or 8½ by 14 inch pages, although other paper sizes and cover shapes are contemplated. For example, these binder covers may be sized to hold and display greeting cards. Also, if the covers are oversized, they may be readily trimmed and cut to the desired size. They may also be shaped as animal, plant, cartoon character silhouettes or other decorative shapes to cover, display and protect the page contents held therein.

These front and back cover segments may be equal in size to form a folded binder with aligned edges or with overlapping edges, depending upon the requirements and manner of folding about the papers secured therebetween. For example, to store, protect, and display legal documents, the cover is a backing with the top edge having spinal subsegments adapted to folded and bind the edges of the papers as described below. The bound legal document thus has no cover page, but is folded and then stored in an envelope to insure that the document is not tampered with during storage.

In the preferred embodiment, the front and back cover segments are joined with an interior and exterior spine segment containing at least one parallel score which allows the front and back segments to bend over and cover the pages. If more than one score is included, these scores are substantially parallel running the length of the spine to provide a plurality of spinal subsegments which bend and fold to secure these spinal subsegments about and around the edges of the plurality of papers placed therebetween.

The front and back cover segments may include pockets to hold removable inserts, business cards, pens, small calculators, calendars, etc. These pockets may also be adapted as transparent window display pockets into which pictures, messages, printed materials, etc. are inserted for display.

To secure the spinal subsegments to the edges of the paper or the cover, at least one parallel adhesive strip is attached to either side of the cover proximate the spinal subsegments. At least one corresponding removable adhesive strip cover protects the adhesive strip until ready for fastening use. After folding, the adhesive strip cover is removed to expose the adhesive strip to secure folded over spinal subsegments of the cover together about the edges of the plurality of papers.

In one preferred embodiment, the spine segment has five parallel scores forming first, second, third, and fourth spinal subsegments. This cover is made of a plastic, paper, vinyl, leather, cardboard, or other similar materials, which when scored, may be folded in either direction. It may be printed with illustrations, graphics, messages, or personalized with colors and patterns to suit the preference of a user. It may also be partially, or completely transparent to reveal the title of the underlying papers or proposal.

The exterior of the first and fourth spinal subsegments of the cover have adhesive strips covered with removable adhesive strip covers. This enables the edges of the plurality of papers to be placed between the second and third spinal subsegments of the folder which is stapled, glued, or fastened by other means to secure the papers therebetween. Then, the first and fourth spinal subsegment strip covers are removed to fold over and secure the first and fourth spinal subsegments over to stapled edges to cover them. The covers are then folded along the last score over the secured papers to provide an attractive bound report, presentation paper, brochure, greeting cards, etc.

In another preferred embodiment, the spine segment of the cover has three parallel scores forming first and second spinal subsegments. The interior of the first and second spinal subsegments have adhesive strips covered with removable adhesive strip covers. This enables stapled or fastened edges of the plurality of papers to be placed and secured between the first and second spinal subsegments of the cover when the adhesive strip covers are removed and pressed against the fastened edges of the papers. The front and back of the cover is then folded back along the score to secure about the secured pages and provide a bound presentation report, sales brochure, etc. This embodiment is particularly suited for making customized greeting cards. A decorative scored cover is folded as described above. Then a personalized message is printed on a computer, or other machine. The adhesive strip covers are then removed and the message secured between the decorative scored cover to provide a personalized greeting card.

In the simplest embodiment, the spine segment is one parallel score between the front and back cover segments.

The scored segment is covered by an overlapping adhesive strip covered with a removable adhesive strip cover. To use this embodiment, the edges of a plurality of papers are first stapled, glued, or fastened together. The strip cover is then removed to expose the adhesive. The fastened edges are then placed and secured via the adhesive strip along the score between the front and back cover segments to cover the fastened edges.

In another embodiment particularly adapted for file storage, the spine segment of the cover has five parallel scores forming first, second, third and fourth spinal subsegments. The interior of the first spinal subsegment has an adhesive strips covering it. This adhesive strip is covered with a removable adhesive strip cover. The cover is then folded along the fourth score exposing the fourth spinal subsegment. Edges of the plurality of papers are then placed against the interior of the back cover and stapled to the fourth spinal subsegment. The adhesive strip cover is then removed to secure the fourth spinal subsegments to the first spinal subsegment when the interior of the back cover is folded about and around the fourth score to convert it into a front cover. This fold leaves the front cover slightly shorter than the back cover. This extended edge of the back cover thus becomes an extended tab to which a label may be affixed for file storage.

The invention may also be sold as a kit. The kit has a scored cover defining interior and exterior front and back segments large enough to cover all or a portion of a plurality of pages with edges. The front and back segments are separated by a bendable spine segment containing a plurality of parallel scores. These parallel scores define substantially parallel spinal subsegments which allow spine subsegments to bend and fold along the scores to secure about and around the edges of the plurality of papers placed therebetween.

The kit cover may also include additional pluralities of parallel scores along different edges of the cover. This enables the fastened edges of a plurality of papers to be secured to the cover in different positions and angles for better display. Also, these kit covers may include pockets similar to those described above.

At least one parallel two sided adhesive strip of a length approximately the same as the spine is included. It has at least one set of removable adhesive strip covers covering the both sides of the adhesive strip until required for fastening use. When ready for use, the cover strips are removed to expose the adhesive strips to secure folded spinal subsegments of the cover together about the edges of the plurality of papers.

As described below the binder system and kit thus provides a readily assembled attractive binder for reports, card display, sales presentations, etc. It can also be assembled in a number of different fold configurations to provide a desired cover binding. These covers may also be pre-printed or decorated with patterns, company logos, slogans, etc. to suit the preference of a user. Alternatively, they may be transparent to provide a protective covering for gift cards, drawings, photographs, etc.

DESCRIPTION OF THE ILLUSTRATED EMBODIMENTS

Figure 1:
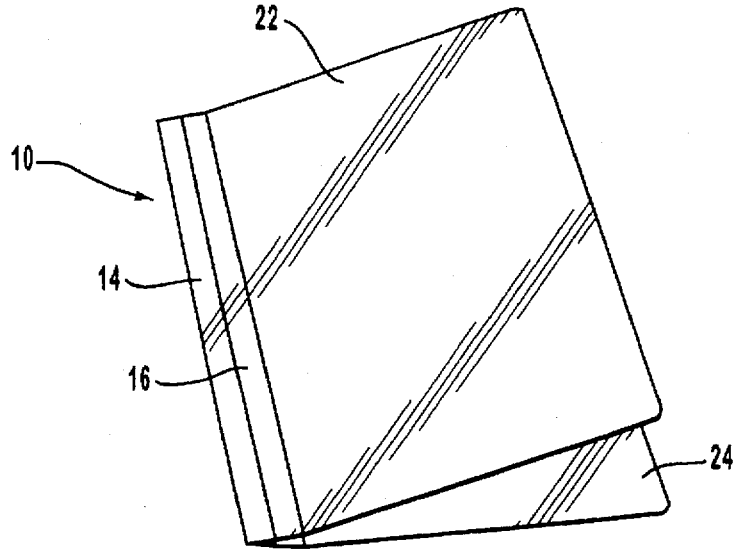
FIG. 1 illustrates a perspective view of a folded cover.
Figure 2:
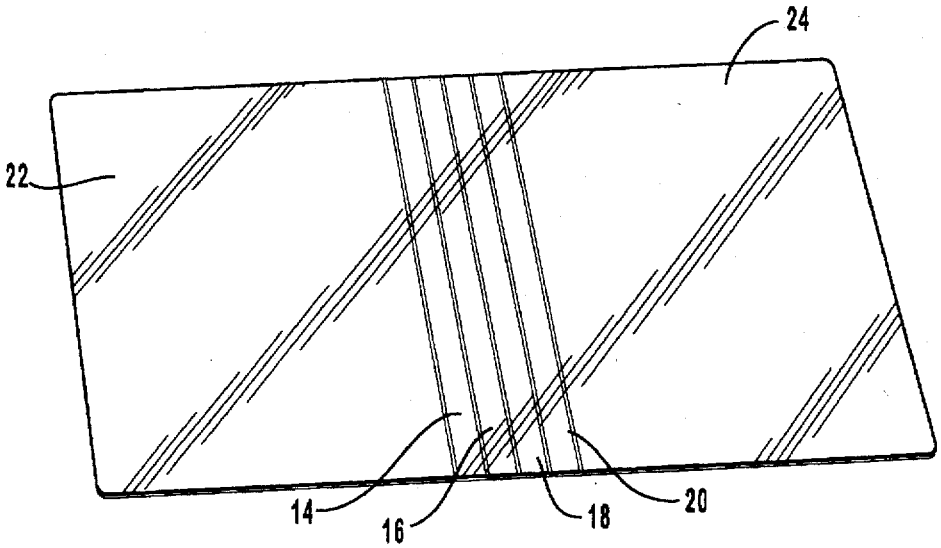
FIG. 2 illustrates a perspective view of the cover shown in FIG. 1 unfolded.
Figure 6:
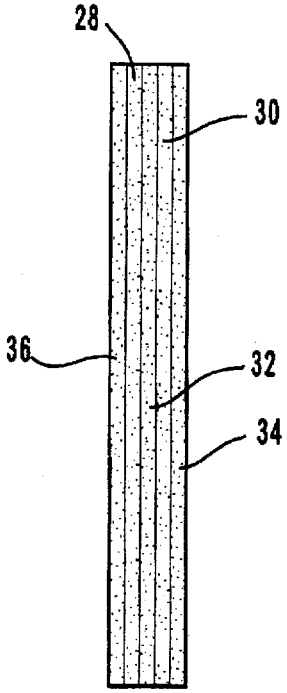
FIG. 6 illustrates a cross sectional view of a two sided covered adhesive strip.

FIG. 1 illustrates a perspective view of one preferred embodiment of a folded cover 10 of the invention 12 made of plastic, cardboard, heavy paper, etc. As shown in FIG. 2, the unfolded cover 10 has four spinal subsegments 14, 16, 18, and 20 separating front and back page cover segments 22, 24. The spinal subsegments 14, 16, 18, and 20 are formed by parallel scores in the spinal segment of the cover 10 such that the cover may bend and fold along these scores. The exterior of segments 14 and 20 are covered with two way tape adhesive strips 26 shown in FIG. 6. These adhesive strips 26 have adhesive coverings 28, 30 on both sides of a center tape strip 32. Removable adhesive covers 34, 36 then cover the adhesive until ready for use.

Figure 3:
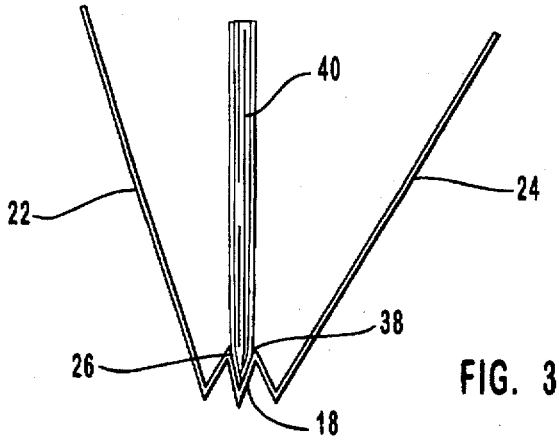
FIG. 3 illustrates a top view of an assembled embodiment of the invention employing the cover shown in FIGS. 1 and 2.

The spinal subsegments 14, 16, 18, and 20 of the cover 10 are folded in an M configuration as shown in FIG. 3. The edges 38 of a plurality of papers 40 are then placed between folded segments 16 and 18 and stapled or fastened thereto. The adhesive strip covers 34, 36 are then removed to secure exterior spinal segments 14, 20 over stapled spinal segments 16 18 as illustrates in the top view of the assembled embodiment shown in FIG. 3.

Figure 4:
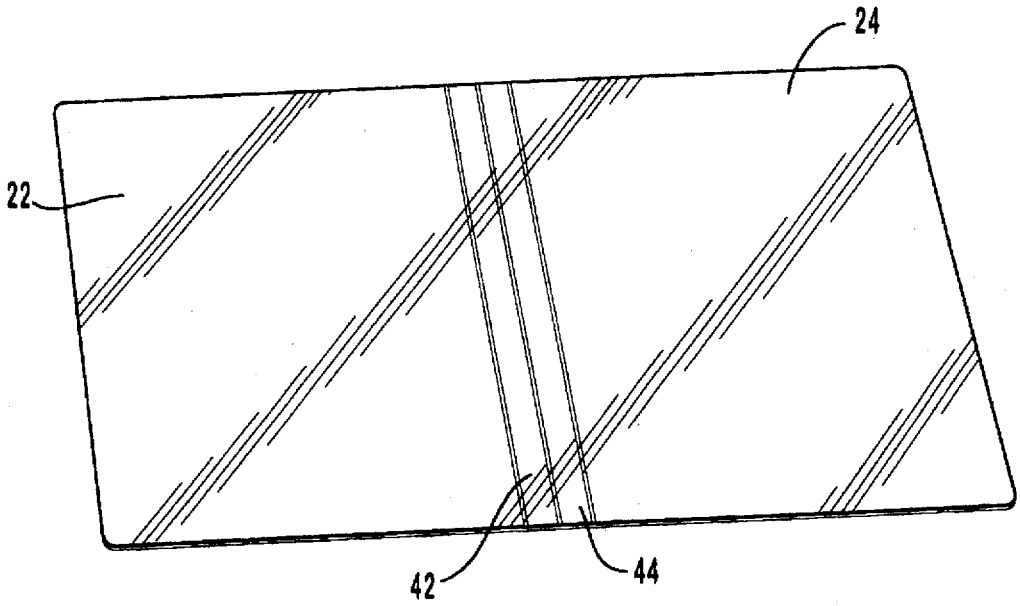
FIG. 4 illustrates a perspective view of another unfolded cover
Figure 5:
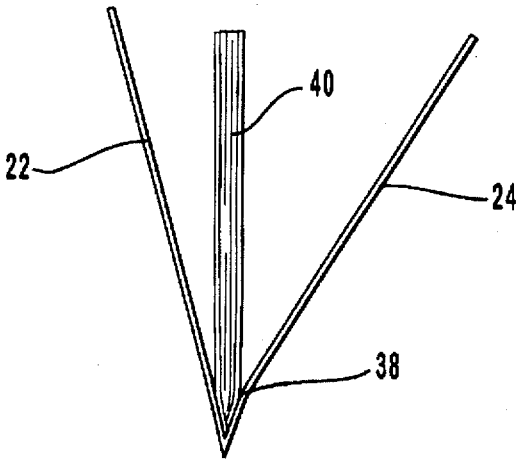
FIG. 5 illustrates a top view of an assembled embodiment of the invention employing the cover shown in FIG. 4.

FIG. 4 illustrates a perspective view of the simplest embodiment of an unfolded cover 10. The cover 10 only has three spinal scores forming two spinal subsegments 42, 44. The interior of these two spinal subsegments 42, 44 is covered by two adhesive strips 26 shown in FIG. 6. As shown in FIG. 5, the assembled embodiment of the invention has the edges 38 of a plurality of papers 40 first stapled or fastened together and inserted between spinal subsegments 42, 44. The adhesive strip covers 34, 36 are then removed to cover to secure the fastened edges 38 between spinal subsegments 42, 44 to form a folded presentation cover shown in FIG. 5.

Figure 7:
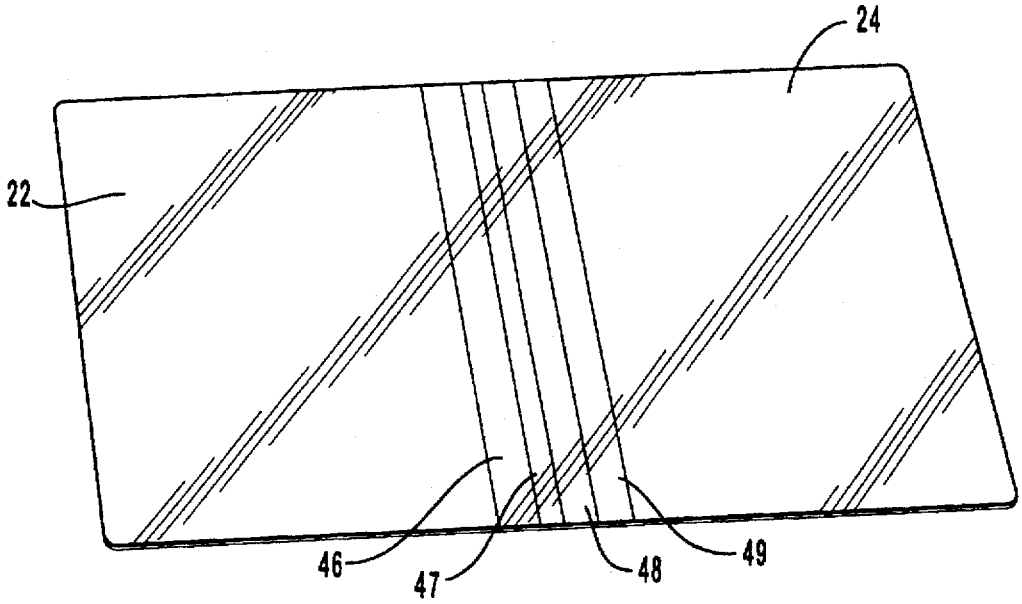
FIG. 7 illustrates a perspective view of another unfolded cover.
Figure 8:
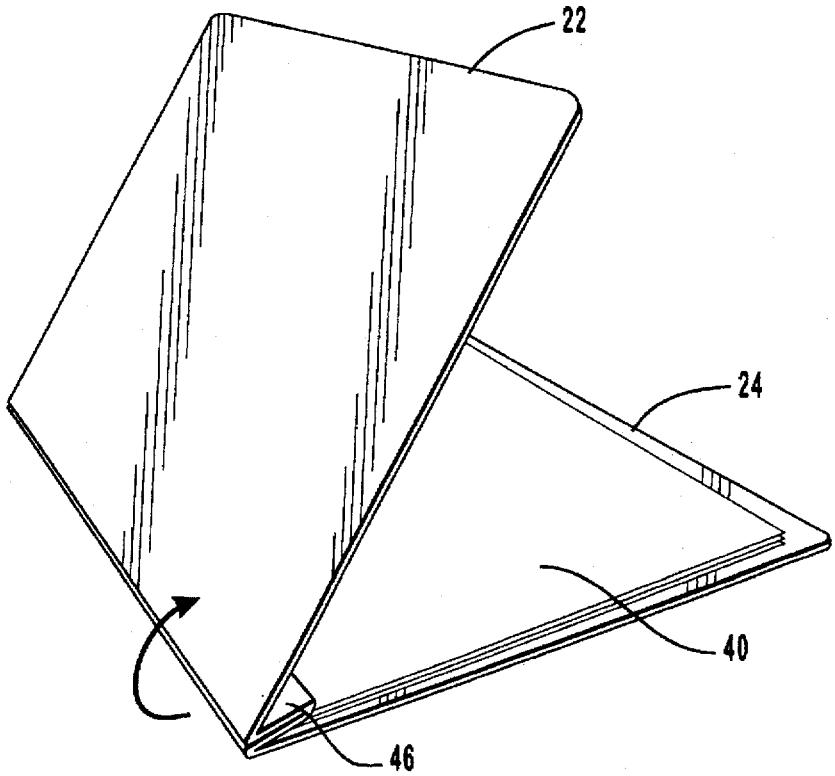
FIG. 8 illustrates a perspective view of the assembled invention employing the cover shown in FIG. 7.

FIG. 7 illustrates a perspective view of another cover variation similar to that shown in FIG. 2. This cover 10 has four spinal subsegments 46, 47, 48, and 49 separating front and back cover segments 22, 24. Two adhesive strips 26 cover spinal subsegments 47, and 48. To use this embodiment, the edges 38 of a plurality of papers 40 are first stapled or fastened together. The cover 10 is then folded in half to position the adhesive strips 26 opposite one another in a V configuration. One of the adhesive strip 26 has its protective covering 28 removed and the stapled edges 38 of the papers 40 are inserted with the V and affixed to the first adhesive strip 26. The second adhesive strip 28 covering 30 is then removed to secure the edges 38 of the papers 40 between spinal subsegments 47 and 48. Cover subsegments 46 and 49 are then folded over and back against the secured segments as shown in FIG. 8 to form a similar spinal W fold shown in FIG. 3.

Figure 9:
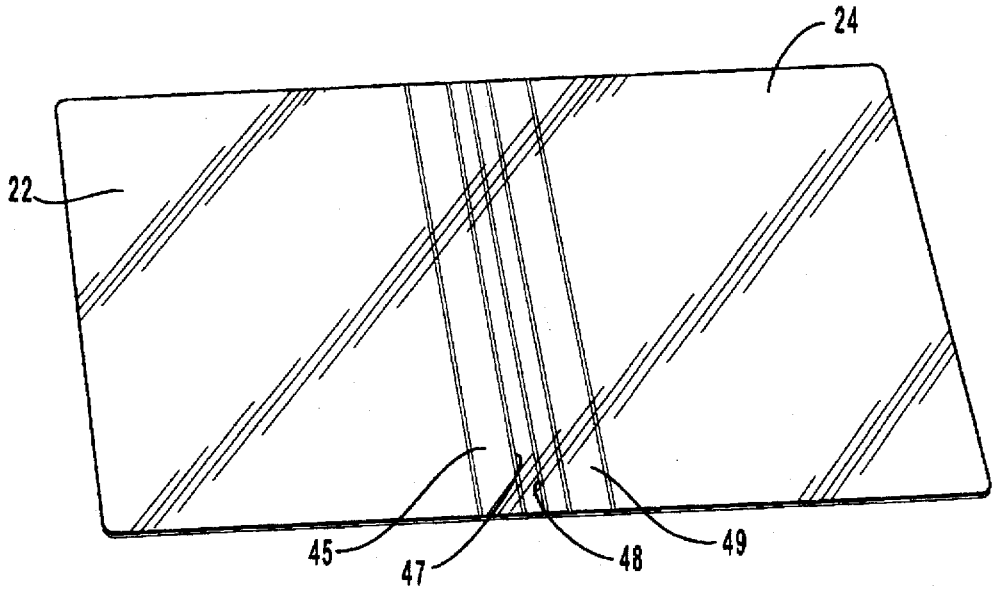
FIG. 9 illustrates a perspective view of another unfolded cover.
Figure 10:
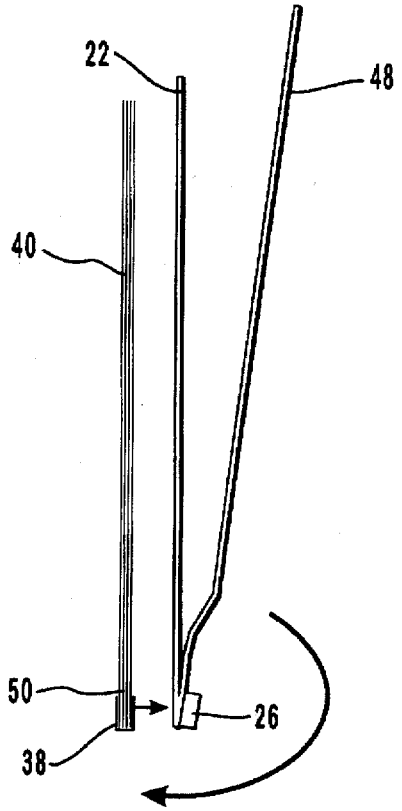
FIG. 10 illustrates a perspective view of a partially assembled invention employing the cover shown in FIG. 9.
Figure 11:
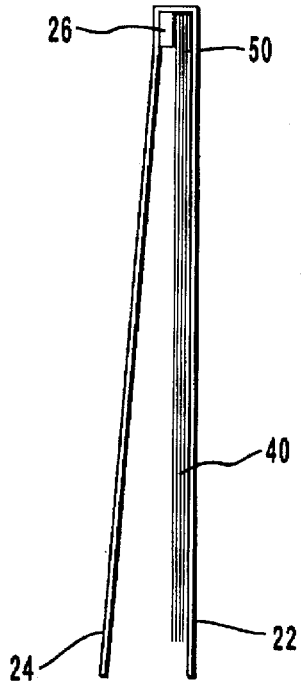
FIG. 11 illustrates a perspective view of an assembled invention employing the cover shown in FIG. 9.

FIG. 9 illustrates another embodiment of an unfolded cover 10 having four spinal subsegments 46, 47, 48, and 49 separating front and back cover segments 22, 24. In this embodiment, a single adhesive strip 26 covers spinal subsegment 46. The cover 10 is folded along the score separating spinal subsegments 46 and 47 to position adhesive strip 26 toward the exterior of the folded cover as shown in FIG. 10. The edges 38 of a plurality of papers 40 are then secured with staples 50 and positioned against cover segment 22 opposite adhesive strip 26 also shown in FIG. 10. The strip cover 28 is then removed exposing the adhesive and the back cover segment 24 is folded over and around to secure the stapled edges 38 to the exposed adhesive between the cover segments 22, 24 as shown in FIG. 11. This embodiment leaves rear cover 24 extending slightly longer than front cover 22 to affix a filing label (not shown) to the extended edge of the rear cover 24.

Figure 12:
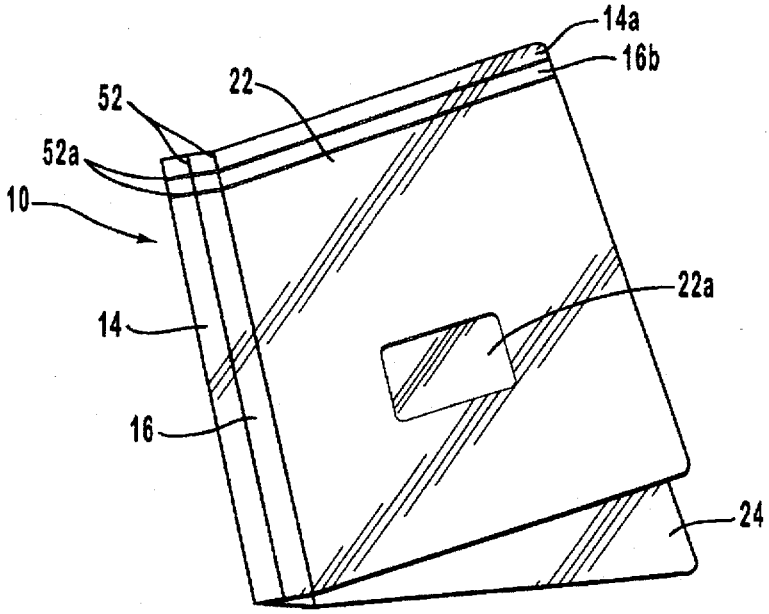
FIG. 12 illustrates a perspective view of a kit.

FIG. 12 is a perspective view of a kit comprising a cover 10 with interior and exterior front and back segments 22, 24 large enough to cover a plurality of pages 40. The front and back segments 22, 24 are connected by an interior and exterior spine segment containing at least five parallel scores 52 defining at least four substantially parallel spinal subsegments 14, 16, 18, and 20 similar to those shown in FIG. 2 which allow cover 10 to bend at between the spinal subsegments 14, 16, 18, and 20. This allows a user to bend and fold the spinal subsegments 14, 16, 18, and 20 to secure about and around the edges 38 of the plurality of papers 40 placed therebetween as described above.

This kit cover 10 also includes a second set of parallel scores 52 running along the top of the cover segment 22,24 which fold along cut 52*a* into substantially parallel top cover subsegments 14*a*, 16*b* to secure paper inserts to the insides of cover segments 22, 24. This kit cover 10 also has a transparent window pocket 22*a* affixed to the front of cover segment 22 into which a business card may be inserted.

To secure these spinal subsegments 14, 16, 18, and 20 in position, the kit includes at least two parallel two sided adhesive strips 26A, 26B of a length approximately the same as the spine 12. The adhesive strips 26A, 26B have at least one set of removable adhesive strip covers 34, 36 covering both adhesive sides 28, 30 of the adhesive strips 26A or 26B until required for fastening use.

Figure 13:
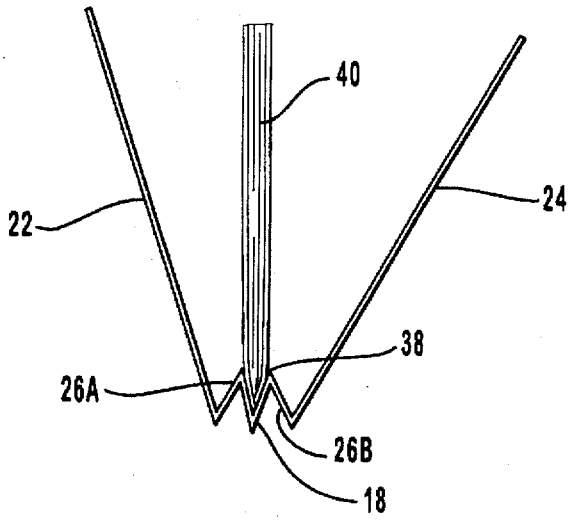
FIG. 13 illustrates a perspective view of one assembled embodiment of the kit shown in FIG. 12.
Figure 14:
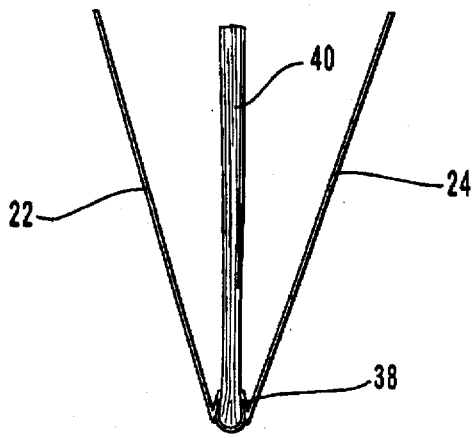
FIG. 14 illustrates another perspective view of another assembled embodiment of the kit shown in FIG. 12.

To use the kit, the cover 10 is folded along the desired scores 52 separating spinal subsegments 14, 16, 18, and 20 in one of the manners described above about the edges of a plurality of papers 40. These papers may be then stapled separately or in association with the spinal subsegments 14, 16, 18 and 20. The strip covers 34, 36 are then removed from at least one adhesive strip 26A or 26B to expose the adhesive layers 28, 30 to secure folded spinal subsegments 14, 16, 18, and 20 together about and to the edges 38 of a plurality of papers 40. For example, FIG. 13 shows two adhesive strips 26A, and 26B employed to secure the edges 38 of a plurality of papers 40 to spinal subsegments 14 and 20 in an M configuration similar to that described above and shown in FIG. 3. In another folding configuration shown in FIG. 14, only one adhesive strip 26A is employed from the kit and secured over the center score 52 located between spinal subsegments 16, 18 to secure the edges 38 of a plurality of papers 40 in a V configuration similar to that described above and shown in FIG. 5. This embodiment is particularly suited to protect and display greeting cards. For this purpose, the cover 12 is made of transparent polycarbonate or plastic.

Figure 15:
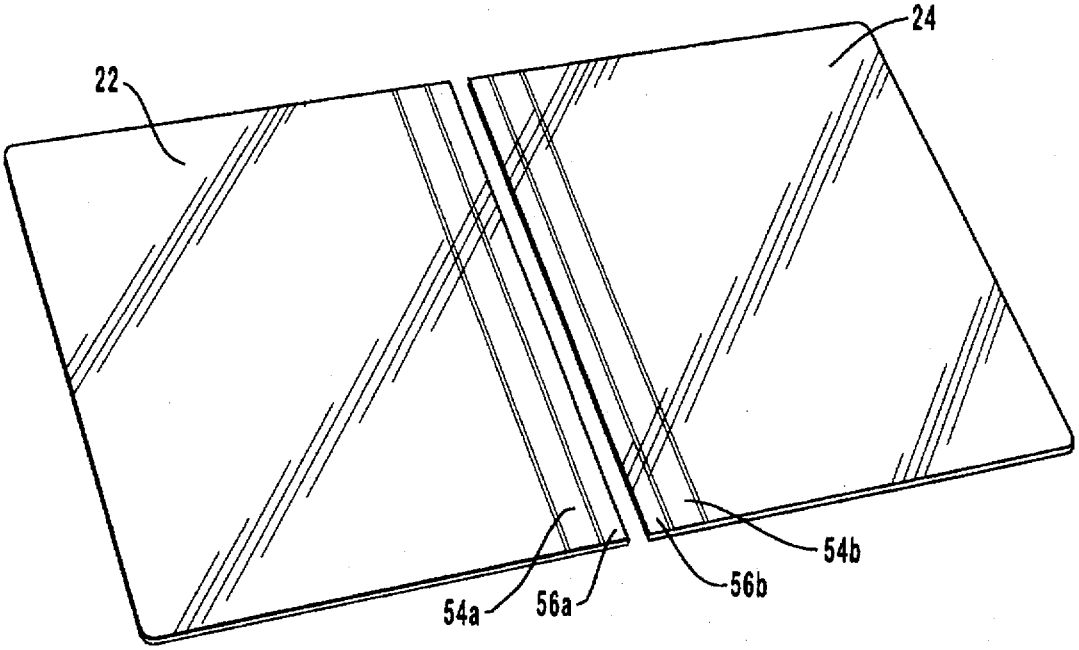
FIG. 15 illustrates a perspective view of a two part cover.

FIG. 15 illustrates a two part cover 12 with separate front and back cover segments 22, 24. Each front and back cover segment 22, 24 has corresponding adhesive strip covered spinal subsegments 54*a*, 54*b* formed by two parallel scores along their corresponding edges forming uncovered binding spinal subsegments 56*a*, 56*b*. The edges 38 of a plurality of papers 40 are then affixed via glue, staples, etc. between and to the binding spinal subsegments 56*a*, 56*b*. The adhesive strip covers are then removed, and the adhesive strip spinal subsegments 54*a*, 54*b* folded back upon front and back cover segments 22, 24 to form a finished bound edge of the binder 12 invention.

Figure 16:
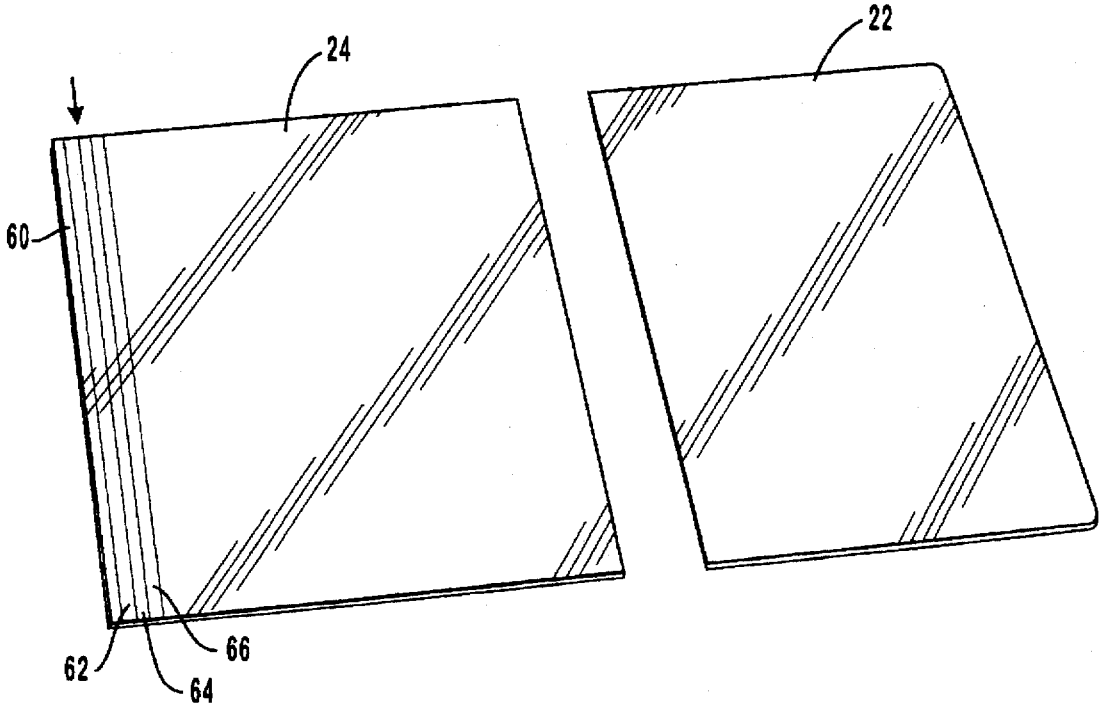
FIG. 16 illustrates a perspective view of another two part cover.

FIG. 16 illustrates another embodiment of a two part cover 10 adapted to store, protect, and display legal documents. The cover 10 is a backing having a back segment 24 with the or top side edge 58 having five scores forming four spinal subsegments 60, 62, 64, 66 adapted to folded and bind the edges 38 of a plurality of papers 40. Spinal subsegments 60 and 66 are covered with adhesive strips 26A, 26B with removable covers similar to those shown in FIG. 12. A clear see through cover 22 sized to cover the top of a plurality of pages of legal documents is then bound, folded, and secured between spinal subsegments 60, 62, 64, 66 via the adhesive strips 26A, 26B.

The binder system 10 and kit thus provides an inexpensive, versatile presentation folder which can be quickly assembled in a number of different fold configurations without the need of sophisticated binding fasteners.

Although this specification has made reference to the illustrated embodiments of the invention, it is not intended to restrict the scope of the claims. The claims themselves recite those features deemed essential to the invention.

We claim:

1. A binder comprising:

a. a cover with i. substantially equal front and back segments sized to cover desired portions of a plurality of pages having edges to be secured, and ii. at least one fold segment defining a central spine and at least a pair of spaced scores that are parallel to said central spine fold defining substantially parallel fold subsegments which may bend and fold the from and back segments about and around the plurality of papers, b. a pair of parallel adhesive strips each attached to a side of the cover proximate to and alongside the fold subsegments, and c. a pair of corresponding removable adhesive strip covers, each covering an adhesive strip which, when ready for fastening use, are each removed to expose an adhesive strip to secure the fold subsegments that are folded over to cover the edges of the plurality of papers.

2. A binder according to claim 1, wherein the spine segment has five parallel scores forming first, second, third, and fourth spinal subsegments, and the exterior of the first and fourth spinal subsegments have adhesive strips covered with removable adhesive strip covers, such that the edges of the plurality of papers may be placed between the second and third spinal subsegments of the folder and fastened thereto; and the first and fourth spinal subsegment strip covers are removed to fold and secure the first and fourth spinal subsegments over to fastened edges.

3. A binder according to claim 1, wherein the pair of parallel spaced scores define first and second spinal subsegments and the interior of said first and second spinal subsegments each include adhesive strips covered with removable adhesive strip covers, such that the edges of the plurality of papers are fastened and may be placed between the first and second spinal subsegments of the folder and the strip covers removed to secure the first and second spinal subsegments over to fastened edges.

4. A binder according to claim 1, wherein at least one of the spine segments parallel scores, between the front and back cover segments, is covered by an adhesive strip that is itself covered with a removable adhesive strip cover, such that the edges of the plurality of papers are fastened and may be placed between the front and back cover segments of the cover when the strip cover is removed to secure the front and back cover segments over to fastened edges.

5. A binder according go claim 1, wherein the spine segment has five parallel scores forming first, second, third and fourth spinal subsegments, and the interior of at least the first spinal subsegments includes at least one adhesive strip that is itself covered with a removable adhesive strip cover, such that, when the cover is folded along the fourth score exposing the fourth spinal subsegment and the edges of the plurality of papers are placed against the interior of the back cover and fastened to the fourth spinal subsegment, and the strip cover may be removed to secure the fourth spinal subsegments to the first spinal subsegment when the interior of the back cover is folded around the fourth score.

6. A binder according to claim 1, including at least one pocket attached to the cover having an opening into which inserts and articles may be removably inserted for storage within an interior compartment.

7. A binder according to claim 6, wherein the pocket is constructed of a transparent material.

8. A binder according to claim 1, including at least one fold segment along a top edge of the front and back cover defining a second plurality of parallel scores to provide substantially parallel top fold segments that may be bent to fold the top front and back fold segments about and around the fastened edges of a plurality of papers; at least one parallel top adhesive strip attached to either side of the cover proximate the top fold subsegments; and at least one corresponding removable top adhesive strip cover covering the top adhesive strip that, when ready for fastening use, is removed to expose the top adhesive strip to secure the top fold subsegments of the cover to the edges of the plurality of papers.

9. A binder according to claim 1, wherein the cover front and back segments are separate pieces, and include corresponding fold segments having corresponding adhesive strips and adhesive strip covers.

10. A binder kit comprising:

a. a cover with i. interior and exterior front and back segments large enough to cover desired portions of a plurality of pages with edges, and ii. at least a pair of interior and exterior fold segments each defining a plurality of parallel scores which provide substantially parallel fold subsegments which allow fold subsegments to bend and fold to secure about and around the edges of the plurality of papers placed therebetween, and b. at least a pair of parallel two sided adhesive strips each of a length approximately the same as the fold segment, and c. at least a pair of sets of removable adhesive strip covers each said set for covering both sides of each said adhesive strip until required for fastening use, at which time said cover strips are removed to expose the adhesive strips to secure fold subsegments of the cover together about the edges of the plurality of papers.

* * * * *